United States Patent [19]

Simion et al.

[11] Patent Number: 5,028,353

[45] Date of Patent: Jul. 2, 1991

[54] PROCESS OF PREPARING A COMBINATION DETERGENT AND SOAP BAR WITH ENHANCED MILDNESS

[75] Inventors: Frederick A. Simion, Hazlet, N.Y.; Robert V. Cantore, Old Bridge; Rair Subramanyam, Perth Amboy, both of N.J.; Domenico Masucci, Union Beach, N.Y.

[73] Assignee: Colgate-Palmolive Company, New York, N.Y.

[21] Appl. No.: 254,869

[22] Filed: Oct. 7, 1988

[51] Int. Cl.[5] ..... C11D 13/18; C11D 17/00

[52] U.S. Cl. ..... 252/121; 252/130; 252/131; 252/132; 252/134; 252/DIG. 16

[58] Field of Search ..... 252/117, 121, 132, 134, 252/DIG. 16

[56] References Cited

U.S. PATENT DOCUMENTS

| | | | |
|---|---|---|---|
| 2,674,619 | 4/1954 | Lundsted . | |
| 2,677,700 | 5/1954 | Jackson et al. . | |
| 2,983,684 | 5/1961 | Langdon | 252/117 |
| 3,417,023 | 12/1968 | DiSalvo | 252/118 |
| 3,419,500 | 12/1968 | Rytter et al. | 252/174.21 |
| 3,640,882 | 2/1972 | Groves, Jr. | 252/121 |
| 3,794,589 | 2/1974 | Fishman | 252/110 |
| 3,814,692 | 6/1974 | Mostow | 252/108 |
| 3,850,834 | 11/1974 | Hellsten et al. | 252/117 |
| 3,928,251 | 12/1975 | Bolich, Jr. et al. | 252/545 |
| 3,931,033 | 1/1976 | Löhr et al. | 252/122 |
| 3,944,663 | 3/1976 | Weiss et al. | 424/78 |
| 3,962,418 | 6/1976 | Birkofer | 424/70 |
| 4,098,818 | 7/1978 | Krummel et al. | 252/170 |
| 4,148,743 | 4/1979 | Schubert | 252/132 |
| 4,169,067 | 9/1979 | Joshi | 252/132 |
| 4,206,070 | 6/1980 | Jones | 252/174.21 |
| 4,285,826 | 8/1981 | Bertozzi et al. | 252/117 |
| 4,397,754 | 8/1983 | Collishaw et al. | 252/91 |
| 4,547,307 | 10/1988 | Hoppe et al. | 252/107 |
| 4,564,463 | 1/1986 | Secemski et al. | 252/174.17 |
| 4,663,070 | 5/1987 | Dobrovolny et al. | 252/121 |
| 4,673,525 | 6/1987 | Small et al. | 252/132 |
| 4,695,395 | 9/1987 | Caswell et al. | 252/121 |
| 4,719,030 | 1/1988 | Williams et al. | 252/133 |
| 4,721,581 | 1/1988 | Ramachandran et al. | 252/135 |
| 4,767,560 | 8/1988 | Gervasio | 252/108 |
| 4,874,538 | 10/1989 | Dawson et al. | 252/117 |

FOREIGN PATENT DOCUMENTS

| | | |
|---|---|---|
| 796627 | 6/1958 | United Kingdom . |
| 931731 | 7/1963 | United Kingdom . |
| 943927 | 12/1963 | United Kingdom . |
| 945062 | 12/1963 | United Kingdom . |
| 2175005 | 11/1986 | United Kingdom . |

OTHER PUBLICATIONS

Memo from Subramanyam to C. A. Winder describing combars containing 80/20 and 70/30 soap starting from an Irish Spring Soap base and an aqueous alcoholic solution.

Reference entitled, "The Mutual Solubilization of Soap and Lime Soap Dispersing Agents", by Weil et al.

Article entitled, "Surface Active Properties of Combinations of Soap and Line Soap Dispersing Agents", by Weil et al.

Article entitled, "Physical Properties of Blends of Soap and Lime Soap Dispersants", by Weil et al.

Article entitled, "Soap-based Detergent Formulations: Hard Water Detergency of Soap-Lime Soap Dispersant Combinations . . . ", by Noble et al.

Memo from J. Wojtkowski et al. to T. Simion describing the efficacy of low levels of ethoxylated surfactants at reduced collagen swelling.

Article entitled, "Soap-Based Detergent Formulations. The Physical and Chemical Nature of Lime Soap Dispersions", by Weil et al.

Article entitled, "Soap-Based Detergent Formulations I. Comparison of Soap-Lime Soap Dispersing Agent Formulations with Phosphate Built Detergents", by Noble et al.

*Primary Examiner*—Prince E. Willis

*Attorney, Agent, or Firm*—Robert Sullivan; Murray Grill; Richard Ancel

[57] ABSTRACT

A mild complexion soap bar comprising soap and an ethoxylated surfactant with an alkyl chain length of eight or more carbon atoms that act in a synetgistic relationship to reduce skin redness dryness, tightness, and roughness when used in hard water.

1 Claim, 5 Drawing Sheets

PROCESS OF PREPARING A COMBINATION DETERGENT AND SOAP BAR WITH ENHANCED MILDNESS

TECHNICAL FIELD

The present invention relates to mild complexion soap bars.

BACKGROUND OF THE INVENTION

Fatty acid soaps have been widely employed and known for centuries as general all purpose detergents. However, fatty acid soaps have various shortcomings in that they react with calcium and magnesium ions to form water-insoluble salts when used in hard water. These water-insoluble salts, known as lime soaps, form curds which are commonly observed in the bath or basin where they rise to the surface as scum and adhere as an unsightly ring to the bath or basin. The lime soaps may also leave a film or a feeling of tightness on the skin after washing in hard water with fatty acid soaps.

To reduce soap scum, lime-soap dispersants are commonly added to fatty acid soaps and actually prevent the formation of curds by keeping the lime soaps finely divided and suspended in hard water. Use of these lime soaps dispersing agents in soap have been disclosed in U.S. Pat. Nos. 2,983,684, 3,850,834, and 3,640, 882. Examples of dispersing agents combined with soap to decrease curd formation are sulfosuccinate half esters prepared from ethoxylated alcohols, alkyl phenoloxy alkylene ether sulfates, and surfactants. See Weil et al Soap-Based & Detergent Formulations: xx. The Physical and Chemical Nature of Lime Soap Dispensions, presented at the AOCS meeting (Sept. 1975).

Although use of a soap combined with a lime soap dispersant may eliminate lime curd, several problems do arise with this combination. First of all, many mild synthetic surfactants formulated with soap exhibit poor lather performance compared to soap bars which are rich in coconut soap and are superfatted. Secondly, use of anionic surfactants can yield a high lather volume, but are harsh on the skin. Thirdly, skin roughness or cutaneous tightness has been shown to correlate to the ability of different surfactants to bind to the skin. Imokawa et al Nahihi Kaishi 86 473–481 (1976); J. Soc. Cosmet Chem. 85 147–156 (1984).

To eliminate the harshness problem caused by the use of a synthetic surfactant in soap, U.S. Pat. No. 4,673,525 and GB Pat. No. 2,175,005, disclose adding to the surfactant and soap combination, polymeric mildness skin feel aids and moisturizers. These additives comprise between 10.1–35% of the toilet bar. Although skin roughness is eliminated, it is done so through additional additives that may increase production costs and leave the skin with a greasy filmy feeling due to the moisturizers.

On the other hand, harshness was not a consideration in U.S. Pat. No. 4,397,754 disclosing a personal cleaning product. The detergent composition utilized in said patent has the ability to lather in both hot and cold water. A non-ionic alcohol ethoxylate (90–10% by weight) and a fatty acid soap (10–90% by weight) were impregnated on a polyurethane foam for washing purposes; no mildness additives were disclosed in said patent. Therefore use of this personal cleaning product may leave the skin feeling rough.

Thus, there is a need in the art to produce a mild primarily soap based complexion soap bar that can be used in hard water but prevents cutaneous roughness and tightness while exhibiting a high lather performance without additional mildness additives that may leave the skin feeling greasy.

BRIEF DESCRIPTION OF THE INVENTION

The present invention fills an important need in the art by providing a novel primarily soap based cleaning composition, that can be utilized in hard water, and has good lather performance, as well as being less harsh to the skin. No additional moisturizers are needed to prevent cutaneous tightness with this invention.

Generally, this invention relates to the use of fatty acid soaps in combination with an ethoxylated surfactant having an alkyl chain length of at least 8 carbon atoms to prevent overall skin dryness. Low levels of ethoxylated surfactant are utilized with soap to produce a synergistic interaction, thus increasing the rinsibility of this toilet bar from the skin and therefore significantly reducing skin dryness, tightness, and roughness.

A preferred cleansing bar is a toilet bar having from 5 to 35% by weight of an ethoxylated surfactant, from 61 to 91% by weight of soap and about 4% by weight of perfume and titanium dioxide and other adjuvants as desired.

Accordingly, it is an immediate object of the present invention to produce an ultra mild complexion bar that reduces skin irritation by reducing soap residue left on the skin after washing in relatively hard water.

It is a further object of the present invention to create a mild complexion bar that does not use moisturizers and additives to accomplish less cutaneous tightness after washing.

It is a further object of the present invention to produce a soap bar with a surfactant, that has good lathering performance.

Yet another object of the present invention is to decrease the soap retention left on the skin after washing and rinsing and thereby leaving the skin with a cleaner refreshed feeling.

Other objects, features, and advantages of the present invention will become apparent upon reading the following detailed description of the invention when taken in conjunction with the drawings and appended claims.

DETAILED DESCRIPTION

This invention relates to a mild complexion soap bar having high lather performance and excellent skin feel benefits. This mild complexion composition is believed to provide less skin irritation and facial tautness than many commercially available skin soap bars, when used in hard water. The composition of this invention increases the rinsibility of soap residue present on the skin after washing and thereby leaves the skin feeling smooth. This complexion toilet bar causes less skin irritation and acts without any additional moisturizers or skin feel aids that may leave the skin feeling sticky and greasy.

It is believed that a synergistic interaction occurs between a relatively low concentration of ethoxylated surfactants with an alkyl chain of at least 8 carbon atoms and soap to create a greater rinsibility of the soap residue remaining on the skin after washing in hard water.

THE SURFACTANT

The surfactant employed in this invention should be an ethoxylated surfactant having an alkyl chain length of at least 8 carbon atoms. These ethoxylated surfactants include nonionic surfactants such as alcohol ethoxylates or anionic surfactants such as alcohol ethoxysulfates and alcohol ethoxycarboxylates.

The degree of surfactant ethoxylation can vary from 3 upwards. The amount of ethoxylated surfactant can vary from 5% to 75% by weight and still achieve a believed synergistic interaction with the remaining balance (95–25%) of soap. However, a preferred amount of ethoxylated surfactant should be at a low level, i.e., between 5% to 35%.

Other surfactants that have been used in combination with soap to reduce skin irritation, such as coco monoglyceride sulfate, do not interact synergistically to decrease the retention of soap on skin after washing.

Figure 1:
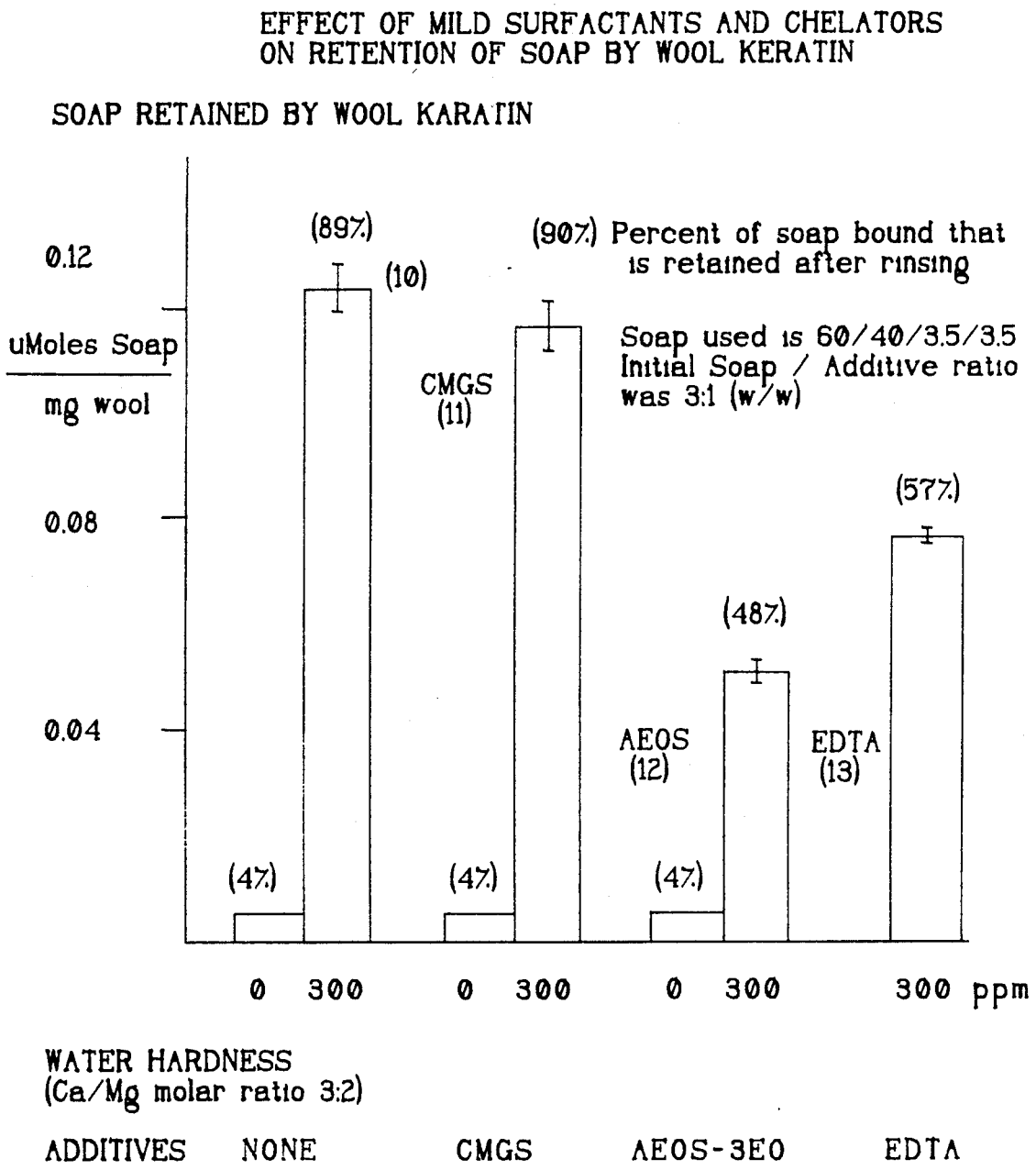
FIG. 1 illustrates the effect of mild surfactants and chelators on retention of soap by wool keratin.

FIG. 1 illustrates the effect of mild surfactants and chelators on the retention of soap by wool keratin in hard water. Since wool keratin mimics a skin-like surface it was utilized in the experiment. The method used is as follows:

To test Rinsibility

Weighed swatches of wool keratin (100 mg.) were incubated in 10 ml. of 0.75% soap solution (radiolabelled with [$^{14}$C]- laurate) and 0.25% mild surfactant, at the appropriate water hardness. After a 20 hour incubation at 50° C. the wool keratin wa filtered dry. The swatches were then reincubated using 10ml of water of the same hardness as used in the first incubation, for 24 hours at 50° C. The swatches were filtered dry and were digested with 2 Molar sodium hydroxide for 1 hour at 80° C, then allowed to cool. The digests were then neutralized with 0.25 ml 70% perchloric acid. The amount of radiolabelled laurate that remained bound to the wool keratin after rinsing has determined by scintillation counting.

Plain soap (10) was retained at the highest level, while the addition of a chelator such as EDTA (13) at a 3:1 ratio of soap to chelator caused a 32% decrease in soap retention after rinsing in hard water.

CMGS or coco monoglyceride sulfate added to the mixture at a ratio of soap of 3:1 to CMGS (11) exhibits almost the same amount of retention as the plain soap alone.

The alcohol ethoxylated surfactant soap (at a 3:1 ratio) (12) shows the greatest decrease in soap retention compared to soap, soap & CMGS, and soap plus EDTA in hard water. Therefore, it is seen that the addition of an ethoxylated surfactant to a soap increases the rinsibility of soap from wool keratin in hard water.

Figure 2:
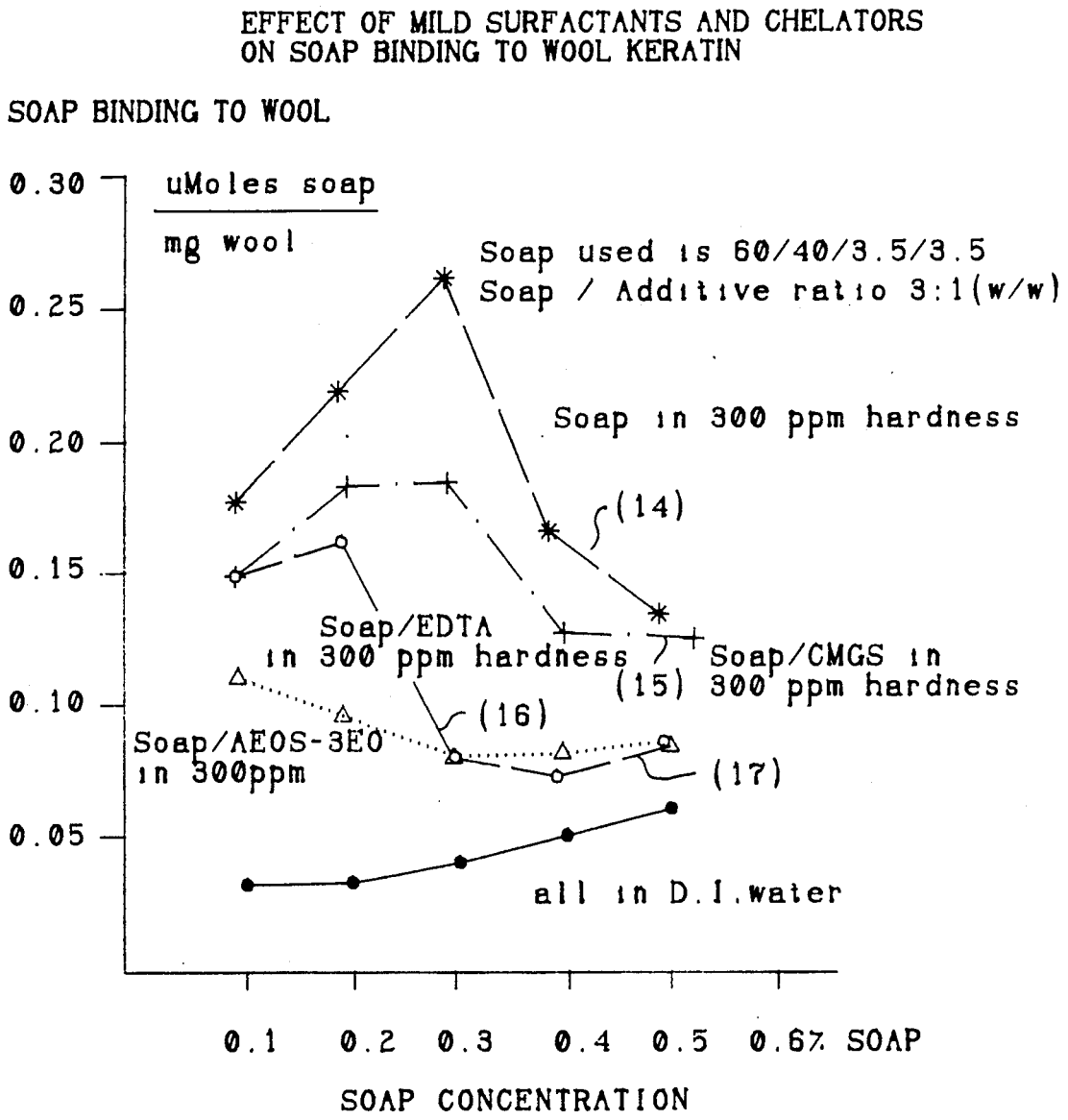
FIG. 2 illustrates the effect of mild surfactants and chelators on soap binding to wool keratin.

FIG. 2 illustrates the effect of mild surfactants and chelators on soap binding to wool keratin. The method employed is as follows:

Methods

(a) Binding

A one percent solution of soap (60 tallow/ coconut 40/ 7 Free Fatty acids) was radiolabelled with [$^{14}$C]-laurate. Swatches of wool fabric (Testfabric #511) were weighed (50 mg.) and then added to the soap and surfactant solution at a defined water hardness. The final volume of solution was 10 ml.. After 20 hours incubation at 50° C. the wool was filtered dry. The swatches were digested with 2 M sodium hydroxide for 1 hour at 80° C., then allowed to cool. The digests were neutralized with 0.25 ml 70% perchloric acid, and the radioactive laurate that had remained bound to the wool keratin after filtration was determined by scintillation counting.

Once again, it is demonstrated that the anionic ethoxylated alchols (17) are the most effective mild anionic surfactant at reducing soap binding to wool keratin in hard water; as compared to plain soap (14), soap /CMGS (in a 3:1 ratio), (15) and soap /EDTA in a 3:1 ratio (16).

Thus an ethoxylated surfactant and soap composition creates an increase in rinsibility and a decrease in soap binding compared to other soaps, alone and other additives such as surfactants to the soaps.

Figure 3:
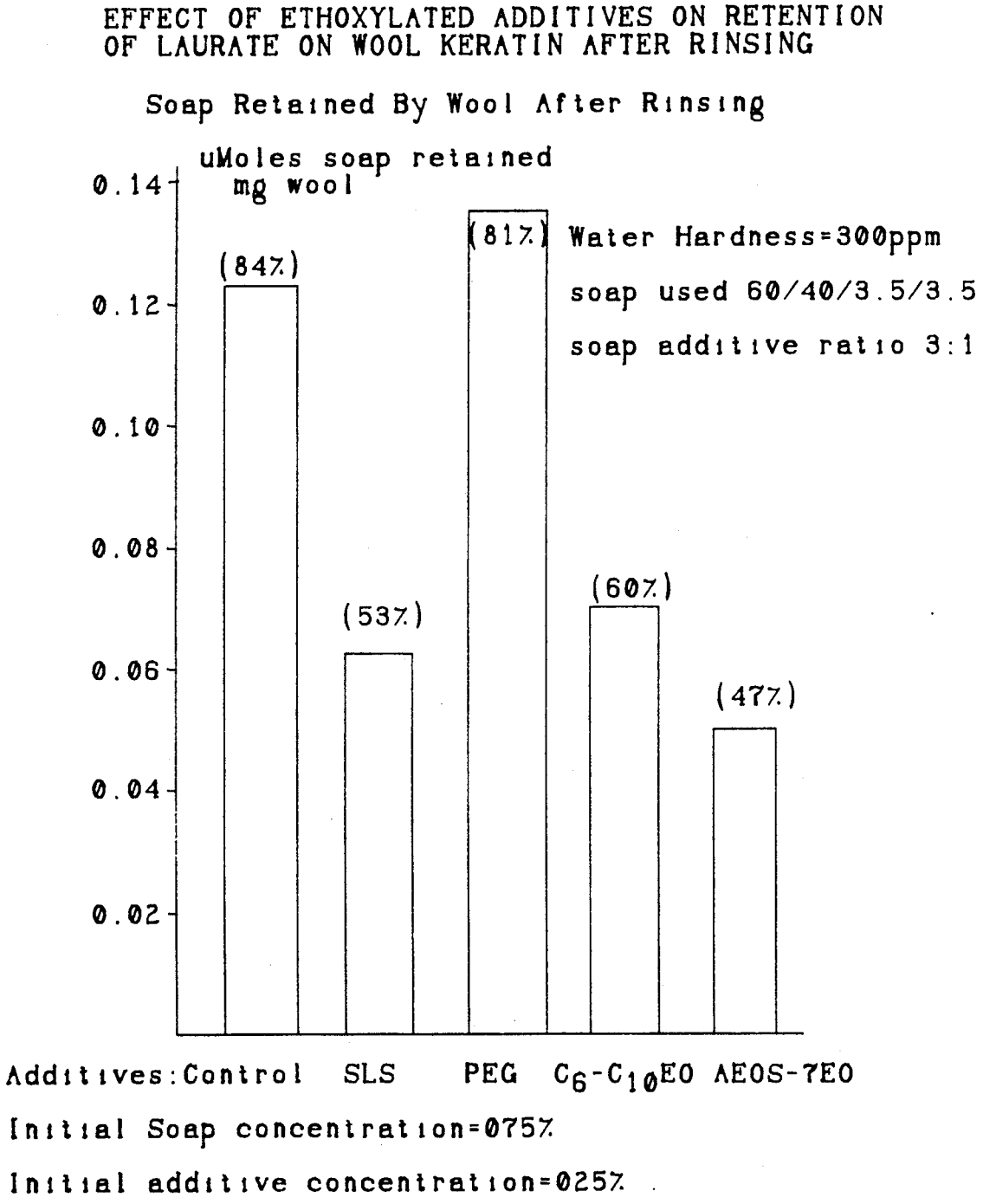
FIG. 3 illustrates the role that the alkyl chain and the ethoxylated moiety have in reducing soap retention on wool keratin after rinsing.
Figure 4:
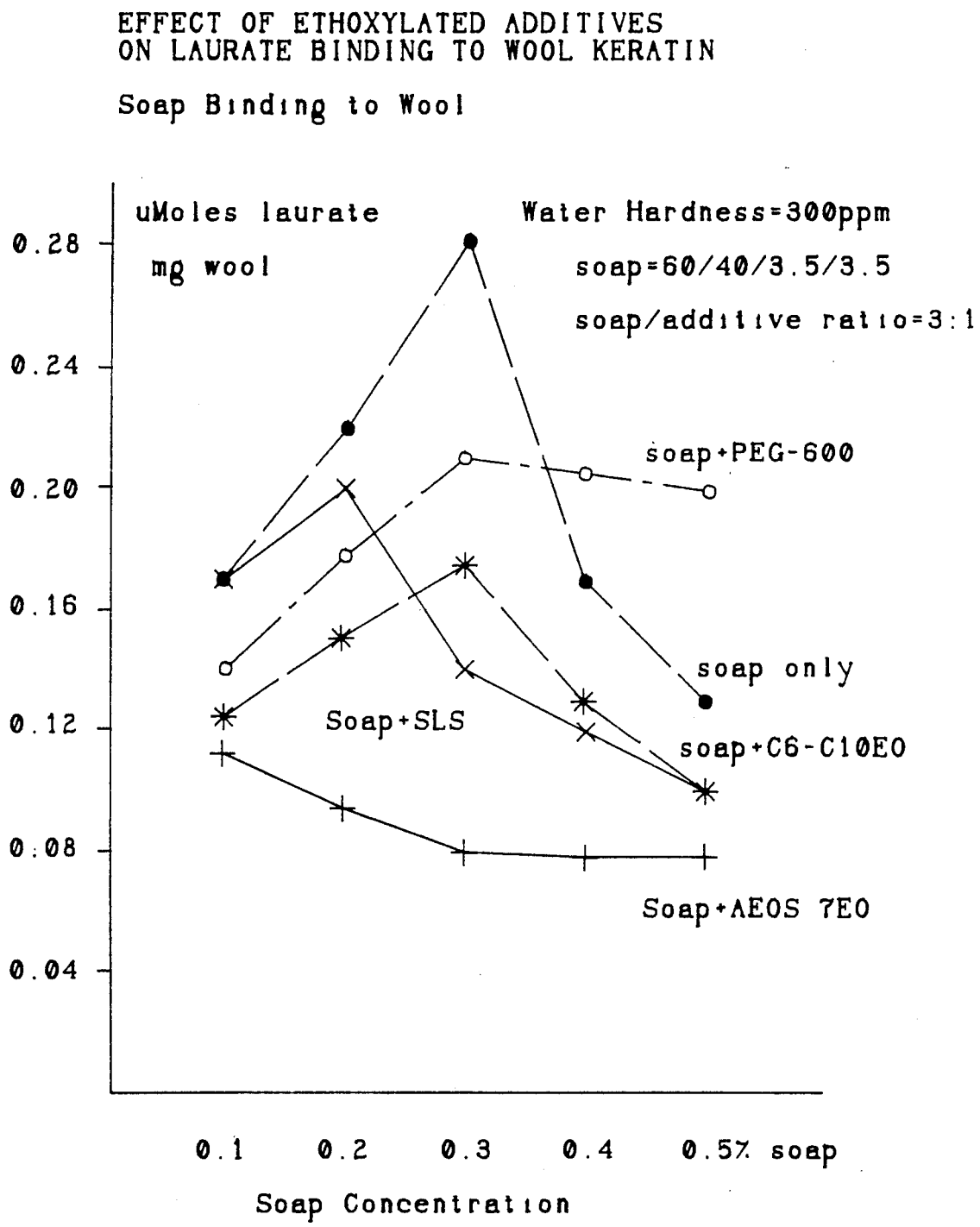
FIG. 4 illustrates the role that the alkyl chain and the ethoxylated moiety have on soap binding to wool keratin.

FIGS. 3 and 4 show that both the alkyl chain and the hydrophilic moiety Sodium lauryl sulfate is not as effective as its ethoxylated derivatives at reducing the soap/-divalent cation interactions that increase binding to wool keratin. On a weight basis, the alcohol ethoxysulphates with different numbered EO groups were equally as effective, suggesting that on a molar basis increasing ethoxylation increases its preferential interaction with the divalent cations (as well as reducing the surfactant's intrinsic irritation potential). The alkyl chain is also required to reduce soap binding to wool keratin. Polyethylene glycol (PEG-600: no alkyl chain increases the binding of soap to wool keratin. A short chain ($C_6$–$C_{10}$) reduced the effectiveness of the surfactant compared with the $C_{12}$–$C_{14}$ chain.

Figure 5:
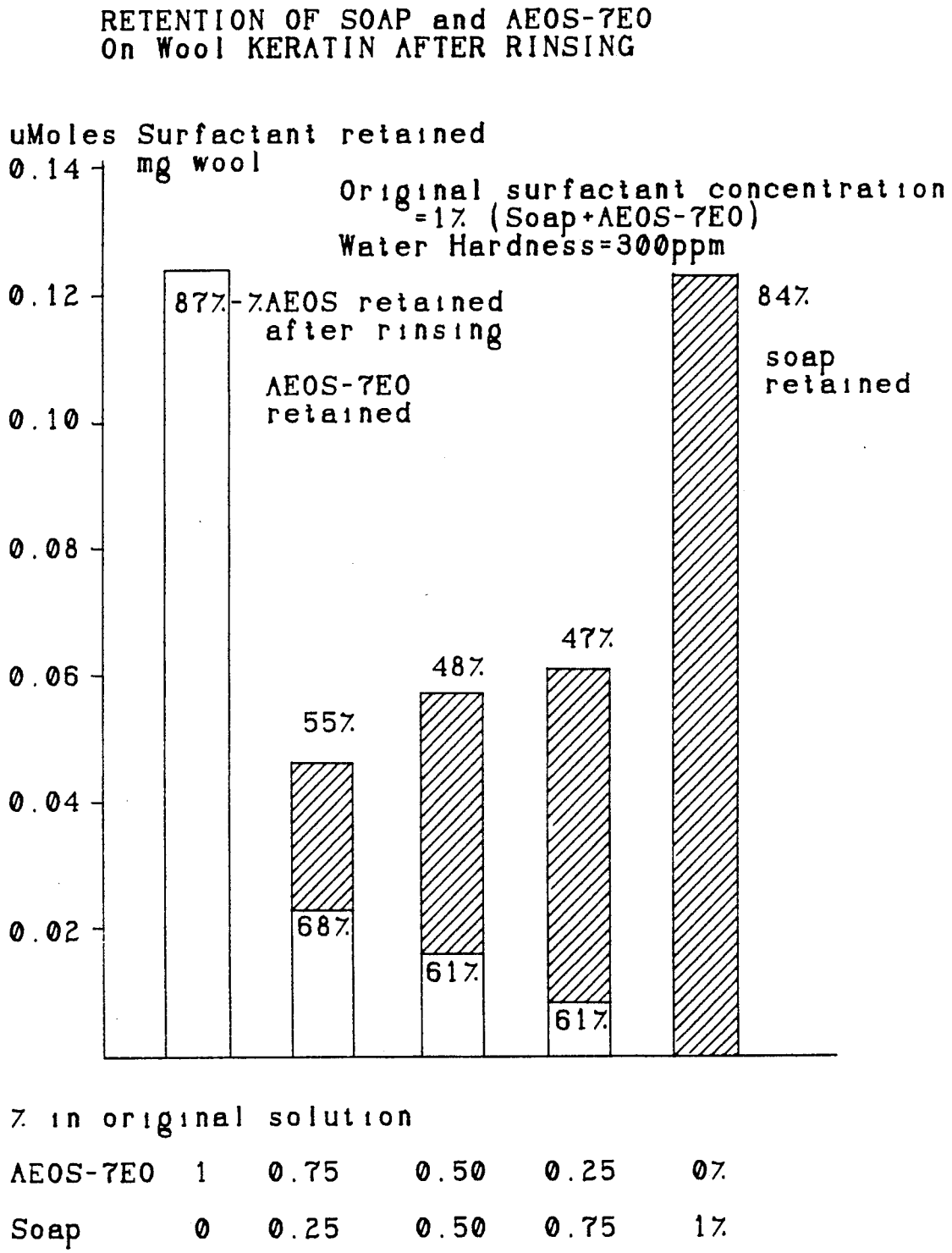
FIG. 5 illustrates the synergistic effect between soap and the ethoxylated moiety to reduce the total amount of surfactant retained on wool keratin.

FIG. 5 shows that there is a synergistic effect between soap AEOS-7EO to reduce the total amount of surfactant retained on the wool keratin. The reason for this is unknown, but is suggests that a syndet bar or combar containing soap and AEOS may be more effective than either surfactant alone at reducing cutaneous tightness and other forms of irritation in vivo.

THE SOAP

Most soaps, salts of fatty acids, and superfatted soaps can be used in this invention. The soap concentration varies with the amount of ethoxylated surfactant utilized in making this soap toilet bar. The soap concentration may vary from 25–95% by weight of the total composition. However, the preferred amount is from 61–91% by weight of the total composition.

OTHER ADDITIVES

Other additives to reduce tackiness of the soap bars such as cellulose ether or synthetic silica, perfume, and whiteners, such as titunium dioxide may be added. A preferred amount to be added is about 1.5% perfume, 0.5% titanium dioxide, and from 0.1 to 2% cellulose ether or synthetic silica.

PROCEDURE FOR MAKING

The procedure for making soap/AEOS combars, which gives the best results, is as follows:

(1) Neat soap is melted in a steam jacketed crutcher (18°-200° F.)

(2) Ethoxylated alcohol sulfate, as a dried paste or an aqueous solution, is added to the crutcher with stirring, and agitation contained for 5 minutes (3) Additives to reduce tackiness, such as cellulose ether or synthetic silica (0.1 to 2.0%) can be introduced into the crutcher at this point and stirring continued for another 2 minutes.

(4) The wet soap is air-dried or vacuum-dried to reduce the moisture level to below 5%.

(5) To milled soap chips, perfume, titanium dioxide and other minor additives are added and milled again (this time with the crimper plate in position)

(6) The soap mix is processed through a Beck plodder (Stephan Beck Plodder Co). The temperature of the plodder is maintained at 90°-100° F. using a water circulation system (7) Bars are pressed from the extruded ribbon using a Midget Multipress (Denison Co) equipped with a standard rectangular die

Lather Assessment

A lather assessment study showed that there was no significant difference between the superfatted control soap bar and a soap/AEOS-7EO (75:25) test bar for lather quickness and there was a small reduction for lather quantity for the test bar.

Mildness Assessment

A mildness test was performed using different concentrations of soap to ethoxylated surfactant. These combars were tested against Dove ®, plain superfatted soap, and a CMGS combar. This study was run double-blind by an independent testing laboratory.

To summarize the methodology is based on Frosch and Kligman J. Amer. Acad. Dermatol. 1 35-41 (1979). The modifications of the original methodology were:

Twenty-seven Caucasian volunteers, with a history of sensitive skin participated in this study.

Transepidermal water loss was used to determine damage to the stratum corneum barrier.

Four test sites on each volar forearm were evaluated prior to product application; this was done after a one hour equilibration in an environmentally controlled room.

Each panelist was patched with each of 8 test products. The sites to which products were assigned were randomized between panelists.

After 24 hours exposure the patches were removed, the test sites rinsed with tap water and patted dry. Irritation was assessed three hours after the patches were removed, by visual inspection and evaporimetry.

After evaluation, sites were repatched with the same product for a further 24 hours, using the method described above.

The evaporimetry data was analyzed using a one way repeated measure ANOVA. Differences between products were probed post-hoc using Fischer's LSD method. The erythema data was analyzed using the Friedman 2 Way Test (non-parametric ANOVA). Product differences were probed by the method of Conover (Practice Nonparametric Statistics pp 299-302 2nd Edition John Wiley and Sons, New York, 1980)

The following compositions were tested in this study:

Composition

5% Dove detergent bar
5 Soap (60/40 superfatted)
5 AEOS-12EO (alcohol ethoxylated surfactant—12 degrees of ethoxylation)
5% 90:10 combar (i.e. 90% soap:10% AEOS-12EO)
5% 80:20 combar (i.e. 80% soap:20 AEOS-12EO)
5% 70:30 combar (i.e. 70% soap:30% AEOS-12EO)
5% 80:20 CMGS combar
5% Soap+1.25% AEOS-12EO

Results and Discussion

This study shows that a complexion bar containing 20 % or more AEOS-12EO, the balance being soap, is as mild as Dove detergent bar. The basis of this result, is that we are combining an irritating ingredient (soap) with one that is significantly milder than Dove (i.e. AEOS-12EO). The mixture has an irritation potential equal to that of Dove. This effect is enhanced by synergistic interactions towards mildness between soap and AEOS-12EO.

Evaporimetry

Results show that after 24 hours, combars containing 20% or more AEOS-12EO elicited comparable irritation to Dove. A combar containing 20% CMGS was significantly more irritating than Dove.

To enhance the sensitivity of the soap chamber test, especially when studying mild products, the test sites were repatched for a further 24 hours. After 48 hours exposure, the skin barrier damage elicited by Dove is equivalent to that caused by soap. In contrast, AEOS-12EO does not damage the skin barrier as much as Dove or soap after 48 hours exposure.

Erythema

Visual assessments of erythema show that after both 24 and 48 hours the 70 soap : 30 AEOS-12EO combar was equivalent to Dove in its propensity to elicit erythema. After 48 hours, the 80 soap : 20 AEOS-12EO combar was equivalent to Dove and the 70:30 combar, although at 24 hours it elicited significantly more erythema than Dove. (It was already statistically equivalent to the 70:30 combar). Reducing the AEOS-12EO level still further causes a rapid increase in erythema produced at both evaluations. Soap alone was significantly more irritating than any other product tested. Replacing the 20% AEOS-12EO with 20% CMGS caused a significant increase in erythema elicited. This is consistent with CMGS being a more irritating surfactant than AEOS-12EO. AEOS-12EO alone was significantly milder than any other product tested.

Synergistic Interactions Towards Mildness Between AEOS-12EO and Soap

The interactions between soap and AEOS-12EO were probed by comparing a cell containing 5% soap+1.25% AEOS-12EO with the control 5% soap cell. If the irritation caused by these surfactants were strictly additive, the resultant irritation should be greater or equal than that elicited by 5% soap alone. However there is a significant reduction in erythema at both the 24 hour and 48 hour time points. For evaporimetry there is a reduction in skin barrier damage after 24 hours, but it is not statistically significant.

These results suggest there is a synergistic interation between soap and AEOS-12EO towards mildness. The basis for the synergistic interaction between soap and AEOS-12EO is unclear. There may be interactions between the soap and surfactant in solution to reduce the level of irritating species (soap) available to irritate the skin. Alternatively, the AEOS-12EO could compete with soap at the skin's surface, so reducing the amount of the irritant that binds.

What is claimed is:

1. A process of preparing a detergent bar comprising the steps of:

(a) melting a quantity of neat soap at a temperature of about 200° F.;

(b) adding ethoxylated alcohol sulfate to said soap while stirring;

(c) stirring said soap and ethoxylated alcohol sulfate;

(d) introducing cellulose ether or synthetic silica to reduce tackiness;

(e) stirring for an additional two minutes;

(f) drying to reduce moisture to below 5%;

(g) milling said mixture a first time and thereafter adding minor additives to said mixture;

(h) milling a second time;

(i) plodding said mixture while maintaining a temperature between 90°–100° F.;

(j) extruding said mixture into a plurality of ribbons;

(k) pressing said ribbons into bars;

(l) recovering the toilet bar product.

* * * * *